US005387416A

United States Patent [19]

White et al.

[11] Patent Number: 5,387,416

[45] Date of Patent: Feb. 7, 1995

[54] TOBACCO COMPOSITION

[75] Inventors: Jackie L. White, Pfafftown; Thomas A. Perfetti, Winston-Salem, both of N.C.

[73] Assignee: R. J. Reynolds Tobacco Company, Winston-Salem, N.C.

[21] Appl. No.: 97,350

[22] Filed: Jul. 23, 1993

[51] Int. Cl.[6] ..... A61K 31/465

[52] U.S. Cl. ..... 424/197.1; 131/352; 131/353; 131/356

[58] Field of Search ..... 131/352, 353, 356; 424/197.1

[56] References Cited

U.S. PATENT DOCUMENTS

| | | | |
|---|---|---|---|
| 904,521 | 11/1908 | Ellis . | |
| 1,376,586 | 5/1921 | Schwartz . | |
| 3,067,068 | 12/1962 | Finberg . | |
| 3,071,476 | 1/1963 | Werft et al. | 99/135 |
| 3,098,492 | 7/1963 | Wurzburg et al. | 131/140 |
| 3,166,078 | 1/1965 | Parmele et al. | 131/5 |
| 3,757,798 | 9/1973 | Lambert | 131/5 |
| 3,901,248 | 8/1975 | Lichtneckert et al. | 131/2 |
| 4,256,126 | 3/1981 | Seligman et al. | 131/17 |
| 4,515,769 | 5/1985 | Merritt et al. | 424/49 |
| 4,624,269 | 11/1986 | Story et al. | 131/352 |
| 4,893,639 | 1/1990 | White et al. | 131/369 |
| 4,917,161 | 4/1990 | Townend | 131/352 |
| 4,975,270 | 12/1990 | Kehoe | 424/48 |
| 5,167,244 | 12/1992 | Kjerstad | 131/359 |

*Primary Examiner*—José G. Dees
*Assistant Examiner*—Samuel Barts

[57] ABSTRACT

A tobacco composition includes a tobacco extract and an edible carrier. The composition allows tobacco to be enjoyed orally.

9 Claims, No Drawings

TOBACCO COMPOSITION

BACKGROUND OF THE INVENTION

The present invention relates to compositions which are intended to provide oral pleasure to a human being, particularly by being placed in the mouth of a human being; and in particular, to compositions which include a tobacco component.

Cigarettes, cigars and pipes are popular smoking articles which employ tobacco in various forms and such smoking articles provide enjoyment and satisfaction to the smoker. Tobacco also can be enjoyed in the form of snuff or chewing tobacco.

It would be desirable to provide a manner or method for a human being to enjoy tobacco without the necessity of smoking tobacco.

SUMMARY OF THE INVENTION

The present invention relates to a composition intended to be placed into the mouth of a human being. The composition includes (i) some form of tobacco or source of components characteristic of tobacco; and (ii) a carrier. The carrier is one which is capable of being ingested, and most preferably is a material which is characterized as being edible.

DETAILED DESCRIPTION OF THE PREFERRED EMBODIMENTS

The composition can vary, but includes (i) some form of tobacco or source of components characteristic of tobacco (hereinafter referred to as a "tobacco component"), and (ii) a carrier for holding the tobacco component in order to allow the tobacco component to be inserted to the mouth of a human being. In particular, the composition is most preferably an aqueous extract of tobacco.

The tobacco component can vary. The tobacco component can include finely divided tobacco material (i.e., tobacco powder or fines, particularly from tobacco laminae). The tobacco component most preferably includes a tobacco extract (e.g., tobacco components extracted from a tobacco material using a solvent such as water). If desired, combinations of various forms of tobacco (e.g., a mixture of finely divided tobacco laminae and a spray dried tobacco extract) can be employed. If desired, the tobacco component can be in a highly processed form (e.g., the tobacco components can be heat treated, or subjected to reaction conditions in the presence of sugars and/or amino acids). The tobacco preferably is entirely in the form of an extract, and most preferably in the form of a tobacco extract having a relatively high water solubility. As such, water soluble tobacco extracts are particularly preferred. Tobacco extracts are preferred because of the absence of significant amounts of water insoluble components, such as the biomass of tobacco (e.g., water insoluble cellulosics, lipids and proteins).

The tobacco component can be obtained from one type of tobacco or a blend of two or more types of tobacco. The type of tobacco can include flue-cured, Burley, Maryland or Oriental tobaccos, the rare or specialty tobaccos (e.g., such as those set forth in U.S. Pat. No. 4,819,668 to Shelar et al.), and blends thereof. Certain useful tobaccos include (i) those designated by the U.S.D.A. as Type 35 (One Sucker), Type 36 (Green River) or Type 37 (Virginia Sun Cured), (ii) a cultivar known as *Nicotiana rustica;* (iii) upper stalk leaves of commercial lines of flue-cured tobacco designated by the U.S.D.A. as Types 11–14; and (iv) upper stalk leaves of commercial lines of Burley tobacco designated by the U.S.D.A. as Type 31. The tobacco can be provided in a finely divided or powder form by milling or grinding techniques, and be screened as necessary to provide particles of a desirably small size. The tobacco component can be provided in the form of a tobacco essential oil, a spray dried tobacco extract, a freeze dried tobacco extract, a tobacco aroma oil, a tobacco essence, or a tobacco oleoresin. Exemplary tobacco extracts are provided using techniques as described in U.S. Pat. Nos. 4,967,771 to Fagg et al.; 5,099,862 to White et al.; 5,131,414 to Munoz et al.; 4,986,286 to Roberts et al.; 5,005,593 to Fagg; 5,038,802 to White et al.; 5,197,494 to Kramer; 5,060,669 to White et al.; 5,159,942 to Brinkley et al.; 5,074,319 to White et al.; European Patent Application No. 338,831; and U.S. patent application Ser. No. 07/733,477, filed Jul. 22, 1991.

Tobacco extracts incorporate numerous components of tobacco, and as such, are a form of tobacco. Components characteristic of tobacco include carboxylic acids, amino acids, lactones, esters, amides, imides, anhydrides, aldehydes, carbohydrates (e.g., sugars), nitriles, ketones, alcohols, phenols, pydrines, pyrroles, indoles, pyrazines, ethers, saturated aliphatics, unsaturated aliphatics, aromatics, salts including inorganic ions, and the like. Particularly desirable are flavorful forms of tobacco including many of the alkaloids, sugars, and essential oil components of tobacco.

The carrier can vary. The carrier often provides a significant amount of the weight of the composition which is ultimately intended to be inserted into the mouth of a human being, and of provides a majority of the weight of the composition which is ultimately intended to be inserted into the mouth of the human being. The carrier provides body, desirable form and size, integrity, mouthfeel, and firmness to the composition. Preferably, the carrier provides for a composition which has a rigid character, and has a time-release dissolvable character in order that flavor and satisfaction of the tobacco composition can release the desired amount of the material efficiently and effectively once inserted into the mouth of a human being. Preferably, the carrier provides for a composition having a character such that components of the tobacco component can gradually penetrate the skin of the mouth of the human being, and hence enter the circulatory system of that human being.

The carrier also provides for a composition having a character such that components of the tobacco component gradually are released into saliva in order that the tobacco component can be ingested by the human being. That is, although the carrier can have a chewy character, the resulting composition most preferably has a character such that it can be chewed or otherwise broken or dispersed into smaller pieces which can be ingested readily. The carrier can be of a form such that the composition can allow for incorporation of the tobacco component, provide appealing color, provide no undesirable off-taste, provide pleasant aroma, provide release of tobacco component desired, provide a desirable mouthfeel, are palatable, can be swallowed, and provide for satisfaction to the user. Exemplary carriers can include powdered or granular materials, and can include a mixture of components. Preferred carriers are water soluble and water dispersible materials. Exemplary carriers comprise starch-based materials, including fines of grains such as rice. Gelatin or food gums can be used. Certain preferred carriers can be characterized as digestible by human beings, and as such, carriers such as processed rice material are much preferred over cellulose based materials. The absorbency of the carrier is high in that it will usually hold 2 to 10 times its weight in the tobacco composition, sufficient to pick up large amounts of the tobacco and hold the tobacco sufficiently, without resulting in leaking or transferal of the tobacco to any significant degree to dry material in contact with the resulting composition of tobacco and carrier.

The relative amounts of tobacco component and carrier can vary. Typically, the amount of tobacco component to carrier ranges from about 1 percent to about 90 percent, preferably about 5 percent to about 75 percent, on a dry weight basis. The carrier most preferably maintains its original volume after the tobacco component is provided in intimate contact therewith and is provided in an essentially dry form.

The amount of tobacco component within the composition can vary. Factors depend upon the type of tobacco, the manner or form in which the tobacco is provided and processed, the desired form of the composition of the tobacco which is applied to the carrier, organoleptic characteristics (e.g., flavor and impact) of the tobacco, and chemical make-up of the tobacco. Typically, the amount of tobacco (e.g., in form of water soluble extract) is at least about 100 mg, often at least about 300 mg; but typically does not exceed about 1000 mg, and often does not exceed about 600 mg.

The composition can include at least one other ingredient. Such other ingredient can be an optional ingredient. Exemplary other components, ingredients or additives include pigments, binding agents (e.g., starches, alginates or carrageenans), flavoring agents, odorants, perfumes, time release agents (e.g., gelatins or microcrystalline cellulosics), antibacterial agents, antioxidants, fungistatic agents, humectants (e.g., glycerine and propylene glycol), moisturizers, inorganic fillers (e.g., calcium carbonate, aluminum oxide or magnesium oxide), organic fillers (e.g., microcrystalline oxide or magnesium oxide), organic fillers (e.g., microcrystalline cellulose, such as is available as Ac-Di-Sol or Avicel), and the like. The amount the optional ingredient can range from 0 to about 50 percent, based on the dry weight of the carrier. Exemplary flavoring agents include sugars, cocoa, licorice, and the artificial and natural flavors used in flavoring tobacco products. See, Leffingwell et al., *Tobacco Flavoring Smoking Products* (1972). Water (e.g., moisture) also can be incorporated into the composition by addition to the composition or by incorporation into the tobacco component. The moisture content of the composition can vary and can be determined by experimentation. In many instances, the moisture content of the composition is less than 15 weight percent, often is less than about 10 percent, and is frequently less than 5 weight percent, based on the weight of the composition prior to use.

The manner in which the various components of the composition are contacted with one another can vary. In one aspect, the tobacco components are dissolved or dispersed in a suitable solvent (e.g., water), and the carrier is contacted with the resulting solution or slurry. As such, components of the solution or slurry are mixed with (i.e., incorporated into) the carrier (e.g., gelatin) as the carrier becomes homogenized with the tobacco composition. The resulting mixture of solvent, tobacco component and carrier then are subjected to conditions sufficient to remove significant amounts of solvent therefrom. For example, a carrier which has been contacted with a liquid solution of dispersion of tobacco is removed from the solution or dispersion, and solvent is evaporated from that carrier. As such, a composition having uniform and consistent incorporation of finely divided tobacco component is provided. Such a composition has a jelly-like character. In another aspect, the tobacco components and carrier components can be blended together in a dry form, and compressed to the form of a pill or other suitable shape of relatively high density.

The density of the composition preferably is relatively high in pill form. Normally, the dry carrier exhibits a density above about 1 g/cm$^3$, and typically between about 1 and about 2 g/cm$^3$. For a carrier in the form of a gel, the density is 1 to 2 g/cm$^3$.

The composition exhibits certain desirable characteristics. Such compositions provide for a controlled release of tobacco component to the mouth and circulatory system of the human being, provide a desirable flavor which can be tasted and enjoyed, provide tobacco satisfaction without smoking tobacco, and allow for easy use and re-use as desired by the human being. Such compositions provide a controlled amount of tobacco component having desired flavor characteristics, preferably having a very limited amount of water insoluble tobacco biomass (e.g., less than about 10 percent of the tobacco component is provided by tobacco biomass), have a carrier which provides little if any off-taste and hence provides for the desirable flavor associated with tobacco component, and provides the user with the option not to expectorate any portion of the tobacco component during use of the composition. As such, preferred tobacco compositions of the present invention have tobacco flavor and tobacco release characteristics such that the user does not have to expectorate at all during use of such compositions.

The following examples are provided in order to further illustrate the invention but should not be construed as limiting the scope thereof. Unless otherwise noted, all parts and percentages are by weight.

EXAMPLE 1

A tobacco composition for oral use is provided as follows:

A blend of flue-cured, Burley and Oriental tobaccos in dust form (e.g., finely divided tobacco laminae and stem) is extracted with water in a stainless steel tank at a concentration of about 1 pound of tobacco per gallon of water. The extraction is performed at ambient temperature while mechanically agitating the mixture. The mixture is centrifuged to remove un-extracted tobacco pulp and provide a liquid extract. The liquid extract is concentrated to a solids concentration of about 30 percent dissolved solids using a thin film evaporator. The concentrated aqueous extract is spray dried to provide a spray dried powder. The concentrated aqueous extract is continuously pumped to an Anhydro size No. 1 spray dryer. The dried powder is collected at the outlet of the dryer. The inlet temperature of the spray dryer is about 215° C., and the outlet temperature is about 82° C. The spray dried extract has a nicotine content of about 3 percent, a total sugars content of about 13 percent, and a moisture content of about 6 percent.

A solution is provided by dissolving 0.6 g of the spray dried extract in 40 g of water. Into the solution is added 7.1 g KNOX unflavored gelatin available from KNOX Gelatin Inc., Englewood Cliffs, N.J. 07632, and 1 g Golden Light Brown Sugar from Savannah Foods & Industries Inc., Savannah, Ga. 31402. The mixture is heated on a hot plate to evaporate water to the point where it is very thick. The composition, upon cooling, has a rubbery character gel an overall moisture content of about 10 percent. The composition is cut into pieces of about 1 g or less weight and used as follows:

The tobacco composition is placed in the mouth of the user at either the side of the cheek, or in the buccal cavity in the region thereof between the lower front teeth and below the lower lip. The composition provides good tobacco taste and satisfaction to the user. The user experiences a low amount of saliva forming in his/her mouth, as the tobacco components released from the composition can be readily swallowed. The composition is palatable, and no gritty or fibery material is released into the user's mouth. As a result, the user is not required to expectorate during use of the composition. The composition normally lasts for about 20 to about 60 minutes, at which point the composition has totally dissolved.

EXAMPLE 2

A tobacco composition is provided generally as described in Example 1. However, solution is heated to evaporate more than 90 percent of the water, at which point about 10 percent is added back. The mixture then is heated on high in a microwave oven for 3 to 5 minutes to provide a composition which has a dried, foamed or puffed character. The composition has an overall moisture content of about 10 percent.

EXAMPLE 3

A tobacco composition for oral use is provided as follows:

The spray dried tobacco extract described in Example 1 is mixed with powdered white sugar in equal amounts. The mixed is pressed using 10000 pounds force using a Carver Laboratory Hydraulic Press into cylindrical pellets of 0.76 cm diameter and 0.51 cm thickness. Each pellet or tablet weighs about 0.3 g. The tablet as used has a density of 1.3 g/cm$^3$.

EXAMPLE 4

Tablets are provided as described in Example 3. However, the mixture which is compressed using 5000 pounds force includes 3 parts of the spray dried tobacco extract, 2 parts white sugar and 5 parts ground puffed rice fines. The tablet has 0.81 cm diameter by 0.49 cm thickness with density of 1.12 g/cm$^3$.

The tablet is brown in appearance and has a smooth surface character. The tablet is placed in the mouth of the user and is allowed to dissolve, during which time the dissolved portion of the tablet is swallowed. Each tablet lasts about 10 to about 30 minutes. During use, the user experiences good tobacco taste and satisfaction.

EXAMPLE 5

A tobacco composition is provided as described in Example 4. The tobacco composition, which weighs about 0.3 g, is placed in a sintilation vial in 20 ml of deionized water at about 72° F. After specified times, 1 ml aliquots are withdrawn from the vial after gentle swirling and placed in gas chromatography autosampler vials. After each ml aliquot is removed, 1 ml of deionized water is added back to maintain the liquid volume at about 20 ml. Each aliquot is placed in a Hewlet Packard HP 7575A autosampler and analyzed using an HP 5890A gas chromatograph having a DB 1701, 60 m column of 0.32 mm I.D. and 10 microns thickness, and having a mass selective detector.

The aliquots are analyzed for nicotine over specified times. The amount of nicotine present in each aliquot at various times is set forth in Table I.

TABLE I

| Time (Hours) | Nicotine Concentration (Milligrams/Microliter) |
|---|---|
| 0 | 0 |
| 0.5 | 0.37 |
| 1 | 0.37 |
| 2 | 0.36 |
| 3 | 0.33 |
| 4 | 0.50 |
| 5 | 0.40 |
| 6 | 0.43 |
| 7 | 0.35 |
| 24 | 0.50 |

EXAMPLE 6

A tobacco composition is provided as described in Example 3. The tobacco composition, which weighs about 0.3 g, is analyzed as described in Example 5. The amount of nicotine present in each aliquot at various times is set forth in Table II.

TABLE II

| Time (Hours) | Nicotine Concentration (Milligrams/Microliter) |
|---|---|
| 0 | 0 |
| 0.5 | 0.60 |
| 1 | 0.52 |
| 2 | 1.38 |
| 3 | 0.80 |
| 4 | 1.62 |
| 5 | 0.83 |
| 6 | 1.10 |
| 7 | 1.34 |
| 24 | 1.04 |

EXAMPLE 7

A tobacco composition is provided essentially as described in Example 3. However, 3 parts spray dried extract is mixed with 7 parts white sugar and compressed into a pill or tablet 0.80 cm diameter by 0.39 cm thick. A compression force of 5000 lbs. is used to provide such tablets, and the tablets have a density of 1.4 g/cm$^3$. The tobacco composition, which weighs about 0.3 g, is analyzed as described in Example 5. The amount of nicotine present in each aliquot at various times is set forth in Table III.

TABLE III

| Time (Hours) | Nicotine Concentration (Milligrams/Microliter) |
|---|---|
| 0 | 0 |
| 0.5 | 0.48 |
| 1 | 0.36 |
| 2 | 0.95 |
| 3 | 0.26 |
| 4 | 0.65 |
| 5 | 0.34 |
| 6 | 0.39 |
| 7 | 0.33 |

TABLE III-continued

| Time (Hours) | Nicotine Concentration (Milligrams/Microliter) |
|---|---|
| 24 | 0.32 |

EXAMPLE 8

A tobacco composition is provided essentially as described in Example 3. However, 1 part spray dried extract is mixed with 9 parts white sugar and compressed into a pill or tablet 0.80 cm diameter by 0.39 cm thick. A compression force of 5000 lbs. is used to provide such tablets, and the tablets have a density of 1.4 g/cm$^3$. The tobacco composition, which weighs about 0.3 g is analyzed as described in Example 5. The amount of nicotine present in each aliquot at various times is set forth in Table IV.

TABLE IV

| Time (Hours) | Nicotine Concentration (Milligrams/Microliter) |
|---|---|
| 0 | 0 |
| 0.5 | 0.23 |
| 1 | 0.22 |
| 2 | 0.19 |
| 3 | 0.09 |
| 4 | 0.07 |
| 5 | 0.08 |
| 6 | 0.09 |
| 7 | 0.14 |
| 24 | 0.12 |

EXAMPLE 9

A tobacco composition is provided essentially as described in Example 3. However, 1 part spray dried extract is mixed with 2 parts white sugar and 1 part microcrystalline cellulose available as Avicel pH101, and compressed into a pill or tablet 0.76 cm diameter by 0.51 cm thick. A compression force of 5000 lbs. is used to provide such tablets, and the tablets have a density of about 1.3 g/cm$^3$. The tobacco composition, which weighs about 0.3 g, is analyzed as described in Example 5. The amount of nicotine present in each aliquot at various times is set forth in Table V.

TABLE V

| Time (Hours) | Nicotine Concentration (Milligrams/Microliter) |
|---|---|
| 0 | 0 |
| 0.5 | 0.35 |
| 1 | 0.31 |
| 2 | 0.36 |
| 3 | 0.39 |
| 4 | 0.70 |
| 5 | 0.36 |
| 6 | 0.63 |
| 7 | 0.52 |
| 24 | 0.57 |

The data in Tables I and V indicate that tobacco components are released into liquid water over time. Typically, for preferred samples of the types described in Examples 5 through 9, the amount of nicotine released after 1 hour as measured using the technique described is greater than about 0.2 milligrams per microliter but is less than about 0.7 milligrams per microliter.

What is claimed is:

1. A tobacco composition for oral use, the composition comprising:

(i) a tobacco extract; and (ii) a water soluble carrier wherein the carrier includes processed rice.

2. The composition of claim 1 wherein the carrier includes gelatin.

3. The composition of claim 1, wherein the composition includes an amount of tobacco extract to carrier of about 5 to about 75 percent, on a dry weight basis.

4. The composition of claim 1, wherein the composition includes about 100 mg to about 1000 mg of a water soluble tobacco extract.

5. The composition of claim 1, wherein the composition the carrier exhibits a density of more than about 1 g/cm$^3$.

6. A tobacco composition for oral use, the composition comprising:

(i) a tobacco extract; and (ii) an edible carrier, wherein the edible carrier includes processed rice.

7. The composition of claim 6 wherein the composition includes an amount of tobacco extract to carrier of about 5 to about 75 percent, on a dry weight basis.

8. The composition of claim 6 wherein the composition includes about 100 mg to about 1000 mg of a water soluble tobacco extract.

9. The composition of claim 6 wherein the composition the carrier exhibits a density of more than about 1 g/cm$^3$.

* * * * *